US011742600B2

(12) United States Patent
Sørensen

(10) Patent No.: US 11,742,600 B2
(45) Date of Patent: Aug. 29, 2023

(54) FLAT CABLE CONNECTION

(71) Applicant: HYDRO EXTRUDED SOLUTIONS AS, Oslo (NO)

(72) Inventor: Jens Sandahi Sørensen, Tønder (DK)

(73) Assignee: HYDRO EXTRUDED SOLUTIONS AS, Oslo (NO)

( * ) Notice: Subject to any disclaimer, the term of this patent is extended or adjusted under 35 U.S.C. 154(b) by 260 days.

(21) Appl. No.: 16/980,290

(22) PCT Filed: Mar. 13, 2019

(86) PCT No.: PCT/EP2019/056230
§ 371 (c)(1),
(2) Date: Sep. 11, 2020

(87) PCT Pub. No.: WO2019/175210
PCT Pub. Date: Sep. 19, 2019

(65) Prior Publication Data

US 2021/0005987 A1 Jan. 7, 2021

(30) Foreign Application Priority Data

Mar. 13, 2018 (SE) ..... 1850277-3

(51) Int. Cl.
*H01B 1/02* (2006.01)
*H01R 4/62* (2006.01)
*H01R 43/02* (2006.01)

(52) U.S. Cl.
CPC ..... *H01R 4/62* (2013.01); *H01B 1/023* (2013.01); *H01R 4/625* (2013.01); *H01R 43/02* (2013.01);
(Continued)

(58) Field of Classification Search
CPC . H01B 1/023; H01B 1/02; H01R 4/62; H01R 4/625; H01R 4/02; H01R 43/02;
(Continued)

(56) References Cited

U.S. PATENT DOCUMENTS 3,742,122 A 6/1973 Balvos et al.
4,237,435 A * 12/1980 Cooper ..... H01H 83/02 361/740
(Continued)

FOREIGN PATENT DOCUMENTS

CN 104275557 A 1/2015
CN 107342466 A 11/2017
(Continued)

OTHER PUBLICATIONS

Chinese Office Action (including English translation) issued in App. No. CN201980018705.7, dated Aug. 3, 2022, 5 pages.
(Continued)

*Primary Examiner* — Timothy J Thompson
*Assistant Examiner* — Guillermo J Egoavil
(74) *Attorney, Agent, or Firm* — WENDEROTH, LIND & PONACK, L.L.P.

(57) ABSTRACT

The present invention relates to a first metal cable (1) having a flat upper (A) and a flat lower (B) surface, comprising at least one hollow riser (2) extending approximately 90 degrees from one of the flat surfaces of the first metal cable, the hollow riser being 5 configured to house an end of a second metal cable (3). A connected structure comprising a first metal cable wherein a second metal cable is inserted into the hollow riser (2) of the first metal cable and joined with the first metal cable. it also relates to a method of making a connected structure, joining a first metal cable to a second metal cable by friction welding the second metal cable (3) to the first metal cable by 10 contacting a rotating
(Continued)

tool (4) with the lower surface of the first metal cable in the area underneath the hollow riser.

15 Claims, 2 Drawing Sheets

(52) U.S. Cl.
CPC ..... *H01R 2201/10* (2013.01); *H01R 2201/26* (2013.01)

(58) Field of Classification Search
CPC ..... H01R 43/0207; H01R 2201/10; H01R 2201/26
USPC ..... 174/75 R
See application file for complete search history.

(56) References Cited

U.S. PATENT DOCUMENTS

| | | | | |
|---|---|---|---|---|
| 4,424,619 | A * | 1/1984 | Conrad | F16G 1/28 474/154 |
| 2007/0039168 | A1* | 2/2007 | Schwartzman | H01R 43/0424 29/748 |
| 2009/0059480 | A1* | 3/2009 | Siglock | H01R 33/94 361/664 |
| 2011/0303736 | A1* | 12/2011 | Sigler | B23K 20/021 228/256 |
| 2016/0250984 | A1 | 9/2016 | Gottschlich et al. | |

FOREIGN PATENT DOCUMENTS

| | | | | |
|---|---|---|---|---|
| DE | 102006050709 | B3 | 5/2008 | |
| EP | 2735397 | B1 | 1/2018 | |
| JP | 45-2267 | | 1/1970 | |
| JP | 1-292775 | | 11/1989 | |
| JP | 2005129498 | A * | 5/2005 | H01R 4/02 |
| JP | 2005129498 | A | 5/2005 | |
| JP | 2014-207108 | | 10/2014 | |

OTHER PUBLICATIONS

First Office Action for Corresponding Chinese Application 201980018705.7 (Translation Included), dated Nov. 24, 2021, 9 Pages.
Translation of the Search Report for Corresponding Chinese Application 201980018705.7, dated Nov. 8, 2021, 2 Pages.
Japanese Office Action dated May 9, 2023 in corresponding Japanese Patent Application No. 2020-547212, with English translation.
Preliminary Notice of Reasons for Rejection dated Jan. 31, 2023, in corresponding Japanese Patent Application No. 2020-547212, with English language translation.

* cited by examiner

FLAT CABLE CONNECTION

CROSS-REFERENCE TO RELATED APPLICATIONS

This application is a national phase entry of International Application No. PCT/EP2019/056230, filed Mar. 13, 2019, which claims the benefit of SE 1850277-3, filed Mar. 13, 2018, the disclosures of which are incorporated by reference herein.

TECHNICAL FIELD

The disclosure relates to a flat metal cable provided with a means for connection of a second metal cable, such as an aluminum conductor. The disclosure also relates to a connected structure comprising the flat metal cable, wherein a second cable may be connected to the flat metal cable.

BACKGROUND

Copper to aluminum electrical connections are commonly used to connect copper contacts to aluminum cables in for example battery cable connections. However, problems may arise when welding metal parts of dissimilar material in that brittle intermetallics may form and weaken the joint. There is also a risk for contact corrosion due to the different electrical potential between the metals.

Aluminum-based electrical cables may be desirable due to weight savings and consequent reduction of fuel consumption, and are increasingly replacing the relatively heavy cables made of copper.

A method for electrically connecting a copper cable to a stranded aluminum cable is described in EP2735397. The connection is made by rotating a tool placed with sustained pressure in an area of the bottom part of the contact until the material of the conductor is softened due to increased temperature of the material of the conductor caused by the friction heat generated. The process is limited to round cable connections.

Connections between flat cables and car batteries are described in US2016250984, in which the flat part of an aluminum cable is connected to a vehicle motor battery via a connection bolt by means of ultrasonic or friction welding. The many interfaces of such a joint cause the electrical resistance of the connection to increase.

SUMMARY

The motor space of vehicles may be increasingly limited due to requirements of more functionality of cars and a wish to keep the weight of the car as low as possible. The use of a flat cable takes up less space than a round cable and can more easily be bent to fit into different confined spaces. Flat cables however cannot be joined to other cables in an easy manner. Aluminum very quickly forms an oxide on its surface when exposed to air and the oxide is difficult to break through in welding processes unless special methods are applied.

In some embodiments, the disclosure describes a flat cable with a connection that may be used to join the flat cable to a second cable in a way that limits the number of interfaces in the connection and the number of process steps for joining and at the same time gives a high conductivity across the joint.

In some embodiments, the disclosure relates to a flat cable configured to accommodate a second metal cable, where the flat cable has a hollow riser extending from the flat upper or lower side of the cable. The riser may be located at one or both ends of the cable.

The riser may be welded onto the cable, or attached in other suitable manner, or the flat cable with a hollow riser extending from one of the flat surfaces may be made using reversed extrusion. By integrating the riser into the material of the cable by reversed extrusion the conductivity and the mechanical properties of the cable connection may not deteriorated by a weld.

A part of the cable may be covered by a polymer coating, such as a polyamide coating, in order to isolate the cable from other metal parts of the engine.

BRIEF DESCRIPTION OF THE DRAWINGS

A better understanding of the disclosure is received from the detailed description when read in conjunction with the accompanying drawings.

DETAILED DESCRIPTION

The disclosure provides, in one embodiment, a first metal cable (here forth called the flat metal cable) that may have a flat upper and a lower surface, located opposite each other, comprising at least one hollow riser extending approximately 90 degrees from one of the flat surfaces of the cable, the riser being configured to house a second metal cable. In some embodiments, the cable may be made from commercially pure aluminum or an aluminum alloy, and may be made from one of the alloys AA1370, AA8176, or AA1350, etc.

In some embodiments, the flat metal cable may have dimensions 1-30 mm height and 10-80 mm width, or 1-5 mm height and 10-30 mm width, but other dimensions are of course possible.

In some embodiments, there may be one or several risers extending from the flat surface of the cable, and the riser may located at one or both ends of the cable. The riser and the cable may be made as one part without interconnecting welds or joints.

Figure 3:
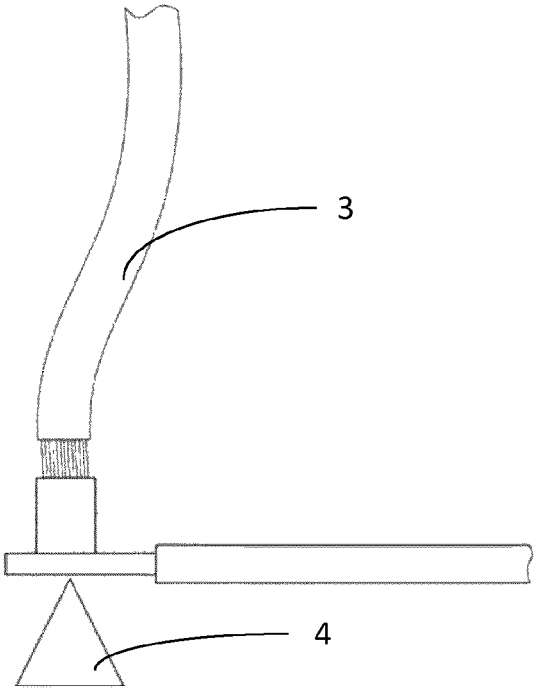
FIG. 3 shows a connected structure comprising the flat metal cable according to the disclosure.

In some embodiments, the disclosure may also include connected structure according to FIG. 3 comprising the flat metal cable, wherein a second metal cable 3, such as a stranded aluminum cable, may be connected to the hollow riser by inserting the second cable into the hollow riser and joining the cables, e.g., by friction welding of the second metal cable with the lower surface of the flat cable in the area underneath the riser. The second metal cable may be a cable of rounded shape. A round cable may be easier to bend in all directions so that the shape can be adapted to various requirements. A flat cable may be useful when a higher heat emission may be desired due to the larger surface/cross section ratio of flat cables in comparison to round cables. A flat cable ratio may also provide an easy connection to other parts by welding, e.g., friction stir welding, or similar processes. Moreover, a flat cable may provide a small bending radius as it may be bent to a radius of almost 0°, or may be helpful if the cable may be hidden in the compartment. A combination of the flat metal cable and a round or rounded cable may provide a combination of the above features.

The friction welding may be performed by inserting the second metal cable into the hollow riser and contacting a rotating tool with the lower surface (B) of the flat cable in the area underneath the riser or by rotating the second metal cable inside the hollow riser until a partial melting of the second metal cable and/or the riser bottom surface (C) takes place.

Figure 1:
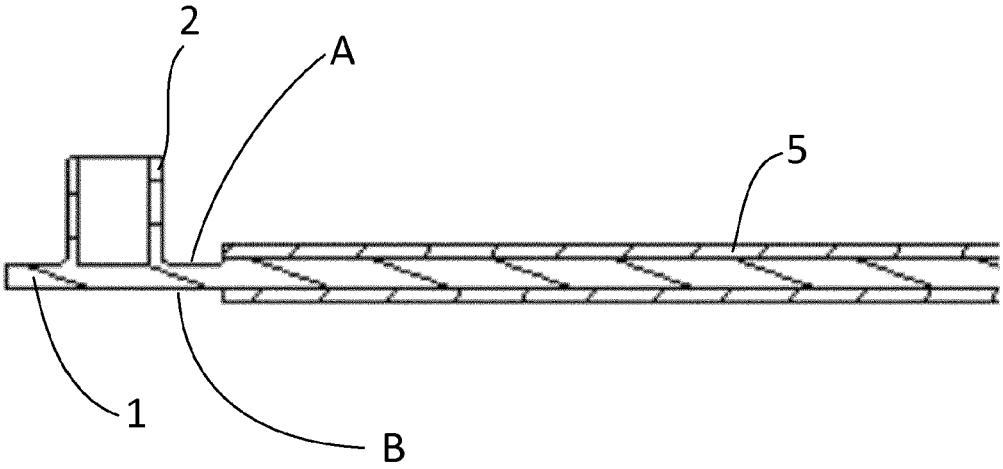
FIG. 1 shows a drawing of the flat metal cable according to the disclosure.
Figure 4:
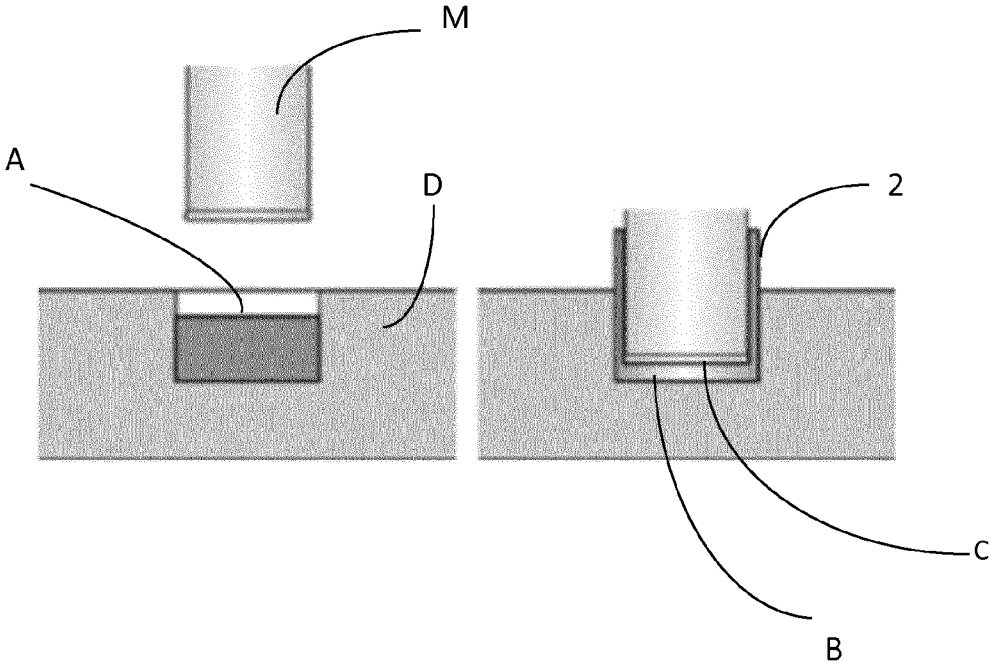
FIG. 4 shows the process of reverse extrusion used to form the riser on the flat metal cable of the disclosure.

In FIG. 1, an embodiment of the flat cable (1) with the extruded hollow riser (2) is shown. In some embodiments, the cable may be made by extruding a flat solid body from an aluminum billet. The material of the first and second metal cables may be commercially pure aluminum alloy or an alloy with good conductivity and mechanical properties such as AA1370, AA8176 or AA1350. The riser may then be drawn from the solid body by reverse extrusion directly from the flat cable material, as exemplified in FIG. 4. The reverse extrusion may be conducted by forcing a tool, such as a steel block, against the upper flat surface of the cable (A). A moving central ram may force the material to extrude metal from the block up into the cavity of the tool, resulting in a tubular riser extending from the flat surface. Material from the cable may be used for forming the riser, so that the resulting thickness of the flat cable may be somewhat reduced under the riser. In some embodiments, any excess material on the riser may be removed by a cutting operation. Before extrusion of the riser, a part of the cable may be coated with a polymer, e.g., a polyamide, to isolate the cable electrically from the surrounding parts. Battery cables may be exposed to harsh environmental conditions such as high temperatures, oil, dirt, salt water, and wear against which the polymer coating protects. The coating (5) may be applied by co-extrusion, as exemplified in WO2014107112, but also other methods, such as powder coating may be used to coat the cable. A part of the cable may be left uncoated or part of the coating removed so that the metal of the flat cable may be exposed. In such embodiments, the part of the flat cable not coated with a polymer may be inserted into the reverse extruder and material may be drawn into a cylinder hollow riser.

Figure 2:
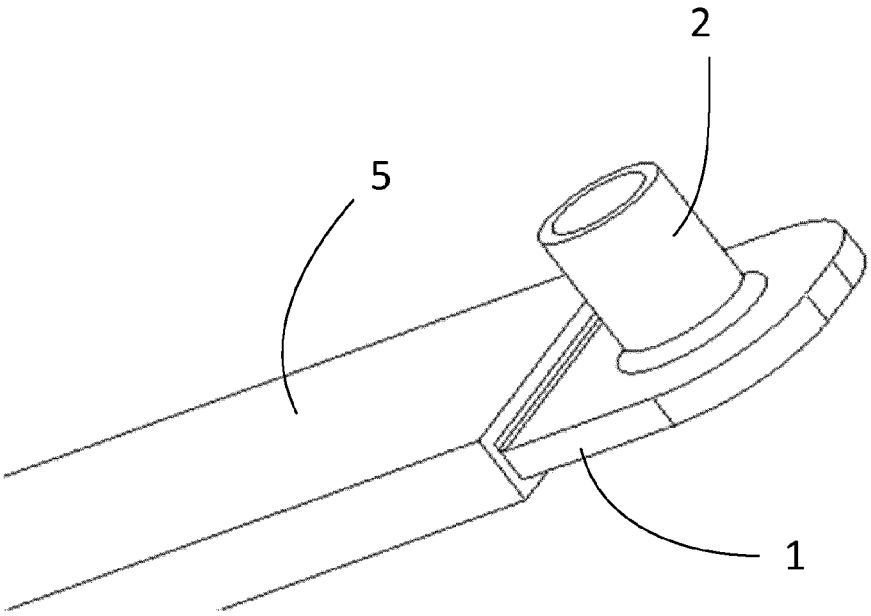
FIG. 2 shows a coated flat metal cable according to one embodiment the disclosure.

In some embodiments, the method may comprise: providing a flat metallic profile (1), forming from the flat metallic profile a riser body (2) having a substantially solid cross-section, by subjecting the metallic profile to reverse impact extrusion by means of a cylindrical extrusion tool (D) comprising a housing mandrel (M). The riser body may be converted into a thin-walled hollow riser by penetration of the mandrel (M) into the riser body and the resulting material flow between the mandrel and the walls of the cylindrical tool. The process may be conducted in one step or by successive formation of the riser body and the riser walls such that a coated cable with the back-extruded riser according to FIG. 2 may be formed.

The riser may be preferably located at one or both ends of the first metal cable, so that the riser occupies a part of the upper surface (A) and that a few millimeters of the first cable may remain flat outside the riser.

In some embodiments, a second metal cable may then be attached to the hollow riser, e.g., by inserting an end of the second metal cable (3), such as a stranded aluminum cable, into the hollow riser and joining the second metal cable to the first metal cable by contacting the tip of a rotating tool (4), such as a steel cylindrical tool with the lower surface (B) of the flat cable in the area underneath the riser. The material of the riser and the stranded cable may be partially melted due to the friction heat generated and, when the tool is retracted, the materials may be joined to form the structure shown in FIG. 3. A connection between the second metal cable and the flat metal cable may alternatively be achieved by rotating the second metal cable after insertion into the hollow riser until the metal surfaces partially melt and join on solidification.

The opening of the riser connection may be circular or oval or any other shape that may accommodate an end of a second metal cable for attachment thereto.

The disclosure shall not be considered limited to the illustrated embodiments, but can be modified and altered in many ways, as realized by a person skilled in the art, without departing from the scope defined in the appended claims.

The invention claimed is:

1. A metal cable connection comprising:

a first metal cable including a flat upper surface and a flat lower surface; and at least one hollow integrated riser reverse extruded from the first metal cable such that the hollow integrated riser and the first metal cable are made as one part without interconnecting welds or joints and the hollow integrated riser includes a bottom surface integrated into the first metal cable, the hollow integrated riser extending approximately 90 degrees from one of the flat upper or flat lower surfaces, and the hollow integrated riser being configured to house an end of a second metal cable.

2. The metal cable connection of claim 1, wherein the first metal cable is made from commercially pure aluminum or an aluminum alloy.

3. The metal cable connection of claim 1, wherein the first metal cable is made from an aluminum alloy selected from the alloys AA 1370, AA8176, or AA1350 alloy.

4. The metal cable connection of claim 1, wherein the hollow riser is located at an end of the first metal cable.

5. The metal cable connection of claim 1, wherein the second metal cable is a stranded aluminum cable.

6. A method for producing a metal cable connection, the method comprising:

providing a first metal cable including a flat upper surface and a flat lower surface; and reverse extruding a hollow riser directly from the first metal cable, the riser extending approximately 90 degrees from one of the flat upper or flat lower surfaces, the hollow riser being configured to house an end of a second metal cable.

7. The method of claim 6, wherein the first metal cable is made from commercially pure aluminum or an aluminum alloy.

8. The method of claim 6, wherein the first metal cable is made from an aluminum alloy selected from the alloys AA1370, AA8176, or AA1350 alloy.

9. The method of claim 6, wherein the hollow riser is located at an end of the first metal cable.

10. A method of making a connected structure, the method comprising:

providing a first metal cable including a flat upper surface and a flat lower surface;

reverse extruding a hollow riser directly from the first metal cable, the hollow riser extending approximately 90 degrees from one of the flat upper or flat lower surfaces; and friction welding a second metal cable to the first metal cable.

11. The method of claim 10, wherein the friction welding is performed by contacting a rotating tool with the flat lower surface of the first metal cable in an area underneath the hollow riser.

12. The method of claim 10, wherein the hollow riser includes a bottom surface, and wherein the friction welding is performed by rotating the second metal cable inside the hollow riser of the first metal cable until partial melting of at least one of the second metal cable or the bottom surface of the hollow riser.

13. The method of claim 10, wherein the first metal cable is made from commercially pure aluminum or an aluminum alloy.

14. The method of claim 10, wherein the first metal cable is made from an aluminum alloy selected from the alloys AA1370, AA8176, or AA1350 alloy.

15. The method of claim 10, wherein the hollow riser is located at an end of the first metal cable.

* * * * *